US005230518A

United States Patent [19]

Crowe et al.

[11] Patent Number: 5,230,518

[45] Date of Patent: Jul. 27, 1993

[54] MEDIATED NAME GAME APPARATUS AND METHOD WITH SOURCE REFERENCE

[76] Inventors: Christina Crowe, 72 Summer Sea Rd., Mashpee, Mass. 02649; Karen L. duLong, 3 Tanglewood Dr., West Yarmouth, Mass. 02673

[21] Appl. No.: 808,368

[22] Filed: Dec. 6, 1991

[51] Int. Cl.[5] ..... A61F 9/00

[52] U.S. Cl. ..... 273/459; 273/299

[58] Field of Search ..... 273/459, 272, 299

[56] References Cited

U.S. PATENT DOCUMENTS

| | | | |
|---|---|---|---|
| 4,690,409 | 9/1987 | Scalia | 273/299 |
| 4,896,889 | 1/1990 | Kuhn et al. | 273/272 |
| 4,900,031 | 2/1990 | Wohl | 273/272 X |
| 5,018,728 | 5/1991 | Liss | 273/459 |
| 5,106,103 | 4/1992 | Fiore | 273/459 |

OTHER PUBLICATIONS

Scrabble advertisement, Playthings Magazine, p. 4, Jan. 1956.

*Primary Examiner*—William H. Grieb

*Attorney, Agent, or Firm*—Thomas A. Kahrl

[57] ABSTRACT

A mediated name game apparatus having a playing board involving randomly drawn playing tiles to be matched with names of noteworthy people having a first set of uniformly colored playing tiles inscribed with letters of and English alphabet and numbers, a second of playing tiles having a second uniform color, also inscribed with letters and numbers, a plurality of bag containers for concealed containment of the first and second sets of playing tiles, the playing board consisting of a tray board divided into a plurality of columns for accepting and retaining the playing tiles corresponding to the first letters of selected by players of names of noteworthy people, and including a game card for listing the names and for scoring the associated numbers contained on the playing tiles selected and for a procedure for challenging and mediationg names selected wherein the mediation is performed by referring to a mutually agreed upon reference source typically a book. The invention also relates to a method of play for matching playing tiles, having letters inscribed thereon, with names of noteworthy people from a selected category of activity, involving a procedure for challenging a one players seection by an other player and for mediating the challenge by referring to an agreed-upon reference book or source.

6 Claims, 1 Drawing Sheet

MEDIATED NAME GAME APPARATUS AND METHOD WITH SOURCE REFERENCE

BACKGROUND OF THE INVENTION

Trivia games which typically incorporate game cards having a clue to the subject matter on the face with an answer on the back for example, the game Trivial Pursuit is a very popular game. Such games test players general familiarity with certain classifications of subject matter, involve individual or team play, and include scoring systems related to game boards. In particular, the game cards ask for names of persons, countries, songs, etc.. Typically, a mediator is picked to randomly select cards from a prearranged file by categories selected by a player or team of players. The mediator then selects a card and reaches the clue from the face of the card and the players have a prescribed time to attempt to give the correct answer, the correct answer being printed on the reverse side of the card which is read by the mediator. Such games require a large number of cards, because as the games become popular, players begin to recognize the questions and answers or memorize them. The mystery quickly fades when the game cards become known or fail to keep up with current popular trends.

The public's interest in television and music of late has focused attention particularly on popular entertainers. Typically, particularly with respect to music, individuals have preferences in selected categories of activity, i.e. be it classical music, semi-classical, punk rock, reg "A", heavy metal, etc.; each group having its' distinctive, popular figures all subject to constant change. On the international front, due to in the political/geographical changes, i.e. in central Europe with the unification of Germany; the disintegration of the U.S.S.R. and individual countries, and with respect to current changes in the Middle East, unexpectedly new political situations with new rosters of key, noteworthy individuals becomes current and then fades from popular public attention, quite quickly. Accordingly, in order to have a continuing, popular trivia game which is based upon the selection of current famous names/popular names, it is important to have a flexible, referenced base of categories of famous people/popular figures which can be changed within the framework of the game, essentially within a moments notice. Another aspect of the game is that is the educational value of teaching participants to become familiar with reference manuals relating to the areas which they have special interests, or alternatively to areas which they are not familiar with and would like to know more about.

SUMMARY OF THE INVENTION

The invention relates to a mediated name game apparatus including randomly drawn playing tiles which are to be matched with names of noteworthy people, the tiles including weighted numbers related to a preselected system giving greater weight to less frequently used letters in names. In particular, the invention concerns a mediated name game puzzle wherein a preselected category of activity of persons is selected, playing tiles are randomly drawn by two or more players drawn from concealed containers, there being a first set of playing tiles having a uniform first color marked with a set of letters from the English alphabet and also marked with a pre-selected number from 1–10 inclusive, a second set of playing tiles having a uniform second color marked with a set of letters from the English alphabet and also marked with a pre-selected number 1–10 inclusive. Also included is a playing tray board divided into two columns of recessed slots, each recessed slot adapted to accept and retain two playing tiles representing the first letters of names of noteworthy people selected by the players. Two containers are provided for separate and concealed containment and storage of the playing tiles as well as a plurality of game cards, each having a plurality of line columns for making selected entries reflecting choices of names of noteworthy people active in the pre-selected activity, and for recording a column of point values taken from the game pieces for scoring the choices of the game players. A timer is also provided which may be varied to vary the difficulty of the game. In the preferred embodiment, scoring includes a mediation process wherein the players, including a first player and a second player, alternatively;

a) agree to that the names selected qualify in the preselected category of activity or alternatively;
b) dispute the validity of the name chosen and ask that a source material be produced which confirms the selection of the player; and
c) lacking such confirmation, the second player asks that the selection of the first player and the point values associated therewith be disqualified.

In the preferred embodiment, the game puzzle is not tied to a set of game cards, rather it may be varied at the option of the games players to any activity currently in vogue and to currently popular figures who are active in the pre-selected area of activity. For this reason, the present invention has a great flexibility, and has the ability to be kept current with current events.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
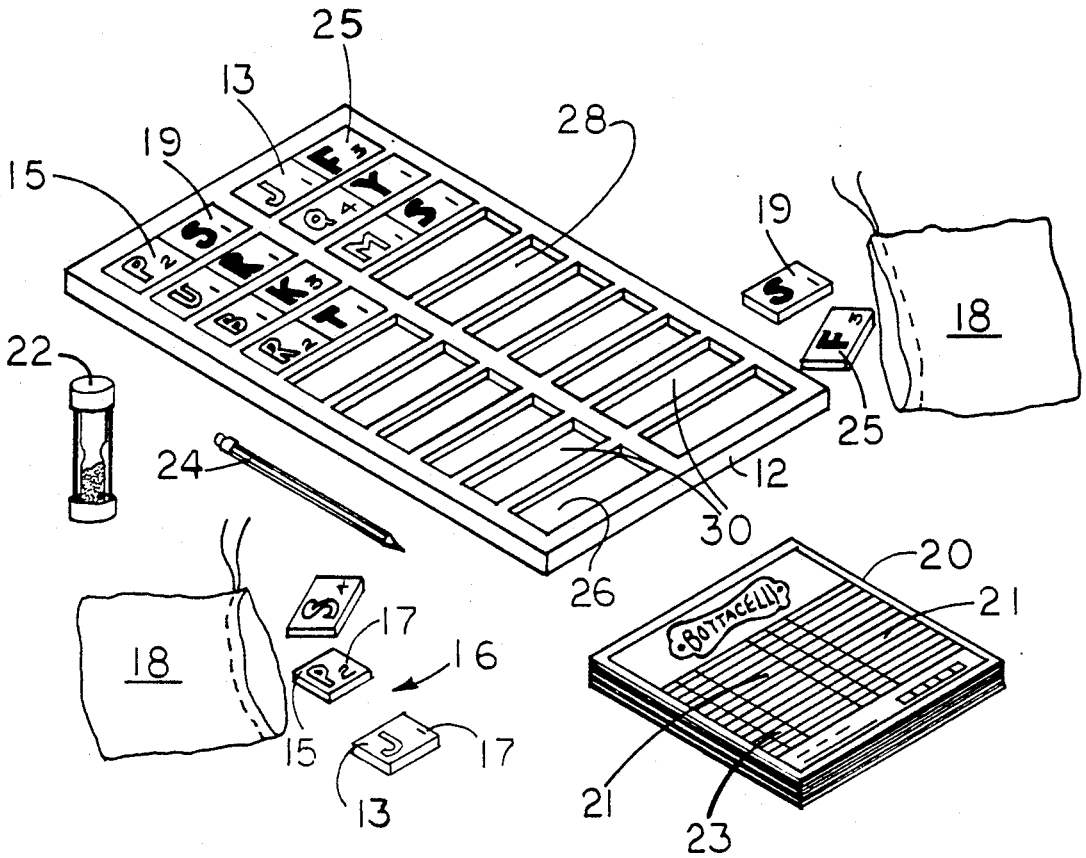
FIG. 1 is a pictorial illustration showing an isometric view of the name game of the present invention.

With reference to the drawings, FIG. 1 shows in combination a board game apparatus 10 including a playing tray board 12, a first set of uniformly colored playing tiles 14, a second set of uniformly colored playing tiles 16, and a plurality of bag containers 18 for separate and concealed containment and storage of the sets of playing tiles 14 and 16. Also included are a plurality of game cards 20 with each card having a plurality of lined columns 21 for making selected entries reflecting choices selected by game players and including a column 23 for point values taken from individual playing tile 15 and 19 for scoring the choices of the game players, a timer 22, a writing instrument 24, typically a pencil.

The playing tray board 12 is divided into two columns, 26 and 28 of recessed slots 30. Each of said columns is adapted to accept and retain two playing tiles 13 and 15 and 19 and 22 respectively and each set having the same uniform color having different alphabet letters 13 and numerical markings of point value 17. Said set of playing tiles 14 and 16 being selected from the English alphabet comprising 26 letters and the numerical point values 17 also marked with a preselected number 1–5 inclusive, the playing tile 13 and 15 being part of the first set 14 intended to be placed in column 26 of the playing tray board 12 of the playing tiles 14 and the playing tile 19 and 20 being part of the second set of playing tiles 16 and intended to be placed in a column 28 of the playing tray board 12; and each tile intended to be placed in the columns 26 and 28 having slots 30, and being of a uniform color and each tile 19.

Figure 2:
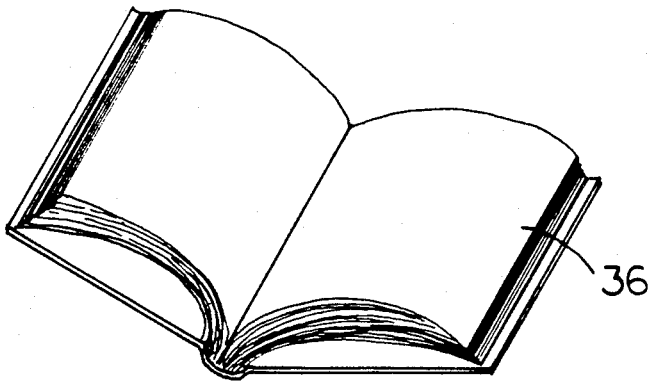
FIG. 2 is a pictorial illustration of a reference source of the name game invention of FIG. 1.

As shown in FIG. 2 a reference book 36 is shown such book being used for mediation purposes in the case of a challenge in the course of the game.

METHOD OF PLAY * FOR INDIVIDUAL OR TEAM PLAY

OBJECT: To come up with recognizable names to fit the initials/letters that are selected randomly during a set time period.

(Suggested time period 10 minutes. Game may be made more difficult or easier by adjusting the time period.)

WHAT NAMES ARE ACCEPTABLE? any famous, noteworthy, well known or recognizable character, real or fictitious, i.e.;. historical figures, TV personalities, cartoon characters, sports figures etc. In fact anything is acceptable IF YOU CAN PROVE IT!!! A good example is: Everyone knows who invented the light bulb and the name Thomas Edison would never evoke a challenge. But should you happen to know who invented the television set and use this gentleman whose initial are V Z (Hey look it up yourself!) A challenge is sure to follow.

WORDS TO PLAY BY --IF YOU CAN PROVE IT YOU CAN USE IT! sources may include any reference books or materials (no phone books allowed)

EXCEPTIONS:

1. Titles such as queen, king, doctor, Mr. are not acceptable unless the title is considered part of the name. This exception will mostly occur with fictitious characters i.e. Queen Elizabeth would not be acceptable while King Kong and Mr. Ed would.
2. Should the same combination of letters occur twice during a game, the same answer may not be used. The same rule applies to several games agreed upon to be played as a match. Therefore, the more games played in a match, the more difficult the game will become.
3. VARIATIONS: Rules can be amended to include only certain categories such as only sports figures, or even tougher only baseball players. How about just TV stars cartoon characters or historical figures. The variations are endless.

LETTER DISTRIBUTION AND POINT VALUES: First and last name letters must be kept separately, thus they are provided in different colors. The reason for this is the point value assigned to each letter which has been determined by the degree of difficulty in the first and last position. For example, a set of initials with a first letter S combined with any other letter of the alphabet has a much higher likelihood of solution than if the letter Q is the first letter in the set.

Because certain letters have very few possible combinations, eight more usable letters are added to each set twenty combinations. REMEMBER point value determines the winner, so strategy should come into play. One set worth 7 points would be more valuable for you to solve than three sets with a total value of 6. Use the allotted time wisely.

TO START PLAY: Agree upon variation rules, if any. Determine time limit for each game and number of games to a match.

1. Letters are pulled alternately, the first name group first, last name group second until the tray board is filled.
2. Fill the score card with letter combinations and their point value, refer to FIG. 1, exactly as they appear in the tray board.
3. Set timer, start play. If playing as teams instead of individually, remember, loose lips sink ships! Keep scrap paper and pencil handy to suggest answers rather than blurt them out.
5. When time is up each team/individual takes turns giving their answer to each combination and challenges are resolved. Total all allowable answer points.

What is claimed is:

1. A method of playing a game for matching playing tiles with names of noteworthy people comprising the steps of;

a) establishing a preselected category of activity of persons, establishing a time limit for play and establishing the number of games to a match;
b) providing a game tray board having a longitudinal axis and a plurality of slots arranged in spaced apart, parallel columns extending along the longitudinal axis of the tray board;
c) providing a first set of playing tiles having a first color, each tile having a letter from the English alphabet comprising 26 letters and a preselected number 1–5 inclusive;
d) providing a second set of playing tiles having a second color, each tile having a letter from the English alphabet comprising 26 letters and also marked with a preselected number 1–5 inclusive;
e) providing a plurality of at least two containers;
f) including at least two players;
g) further including the steps of directing a first player and a second player, of the two players, to alternatively select a playing tile from a container and until each slot in the tray board is filled in the order drawn;
h) inscribing a score card with the letter combinations drawn and their point value exactly as they appear in the tray board;
i) setting the timer and commencing play;
j) entering names of selected noteworthy people on the scorecard until the time is up;
k) selectively challenging an opposing player's selection;
l) mediating challenges of player selections of noteworthy names by referring to an agreed upon reference source.

2. The invention that is claimed in claim 1 wherein the players may play as teams.

3. A board game involving randomly drawn playing tiles to be matched with names of noteworthy people including game apparatus comprising;

a) a tray board divided into two longitudinally extending columns having recessed slots, each recessed slot adapted to accept and retain two playing tiles;
b) a first set of playing tiles having a uniform first color with a set of letters from the English alphabet comprising 26 letters, and also marked with a preselected number 1–5 inclusive;

c) a second set of playing tiles having a uniform second color with a set of letters from the English alphabet comprising 26 letters, and also marked with a preselected number 1–5 inclusive;

d) a plurality of at least two containers for separate and concealed containment and storage of the playing tiles;

e) a plurality of game cards, each game card having a plurality of lined columns for making selected entries reflecting choices selected by game players and includes a column for point values taken from the numbers includes on the playing tiles for scoring the choices of the players;

f) a timer;

g) a mediation means for determining whether a persons name selected qualifies as a correct answer.

4. The board game of claim 3 wherein the timing device includes means for starting a timing sequence and for signalling completion of the timing sequence.

5. The board game of claim 4 wherein the tray board is divided into individual sectors for each player or team, each sector having a column for placing playing tiles, wherein the game is won by a player who chooses names corresponding to the letters of the playing tiles selected having the highest weighted point value within the time sequence.

6. A game apparatus comprising;

a) a playing board;

b) a first set of game pieces comprising a plurality of tiles marked with letters of the alphabet, the first set having a first color and the second set having a second color wherein each tile has a letter of the alphabet and a weighted number;

c) a second set of game pieces comprising a plurality of tiles having a second color and each tile including a letter of the alphabet and a weighted number;

d) a first bag container for containing and concealing the first set of game pieces;

e) a second bag container for containing and concealing the second set of game pieces;

f) a game card;

g) a timer including means for starting a timing sequence and for signaling completion of the timing sequence;

h) mediation means for determining whether a name selected qualifies as an answer;

i) the playing board, is divided into individual sectors, for each player/team, each sector having a column for placing tiles, wherein the game is won by a player who chooses names corresponding to the letters of the tiles selected having the highest weighted value within the time sequence.

* * * * *